United States Patent [19]

Hoke

[11] Patent Number: 5,048,720

[45] Date of Patent: Sep. 17, 1991

[54] TABLET DISPENSER

[75] Inventor: Thomas C. Hoke, Natick, Mass.

[73] Assignee: TCA Group, Inc., Natick, Mass.

[21] Appl. No.: 583,292

[22] Filed: Sep. 17, 1990

[51] Int. Cl.[5] ..... B65H 1/00

[52] U.S. Cl. ..... 221/198; 221/229; 221/269; 221/274; 221/276

[58] Field of Search ..... 221/198, 228, 229, 232, 221/269, 270, 272, 274, 276, 287, 264

[56] References Cited

U.S. PATENT DOCUMENTS

| | | | |
|---|---|---|---|
| 2,669,349 | 2/1954 | Silver | 221/269 |
| 2,782,791 | 2/1957 | Sigo | 221/270 |
| 3,410,455 | 11/1968 | Hoss | 221/229 |
| 3,565,284 | 2/1971 | Hinterreiter et al. | 221/232 |
| 3,854,626 | 12/1974 | Krechmar | 221/264 |
| 4,171,753 | 10/1979 | Vreede | 221/197 |
| 4,295,579 | 10/1981 | Haas | 221/197 |
| 4,311,251 | 1/1982 | Sternberg | 221/229 |

FOREIGN PATENT DOCUMENTS

| | | | |
|---|---|---|---|
| 180891 | 6/1954 | Fed. Rep. of Germany | 221/232 |
| 871685 | 6/1961 | United Kingdom | 221/229 |

*Primary Examiner*—H. Grant Skaggs

*Attorney, Agent, or Firm*—Wolf, Greenfield & Sacks

[57] ABSTRACT

A hand-held tablet dispenser provides a housing having first and second vertically oriented chambers defined by bottom and side walls and a panel separating the chambers. Each of the chambers has an opening at the top. The first chamber includes a magazine that is open at the top and removably mounted for holding a stack of tablets. The tablets are yieldably urged upward to the top of the magazine. Adjacent to the top of the magazine is a discharge opening for allowing the tablets to be dispelled from the magazine as well as a hold down bar at the top of the magazine for preventing the tablets from being forced out the top. A cover is pivotally mounted on the magazine for opening and closing the top of the housing and discharge opening. This cover carries a pusher which forces the topmost tablet in the stack out of the discharge opening when the cover is pivoted to open the discharge opening. A slide is mounted in the second chamber and moves upwardly and downwardly. A bar is also mounted in the second chamber and interconnects the cover and the slide for pivoting the cover between an open and closed position as the slide moves upwardly and downwardly in the second chamber. The slide's thumb grip is accessible from outside the housing so that the user may actuate it while gripping the dispenser.

18 Claims, 4 Drawing Sheets

TABLET DISPENSER

FIELD OF THE INVENTION

This invention relates to a dispenser, and more particularly a dispenser that discharges regularly shaped pieces of candy and gum by means of a thumb slide.

BACKGROUND OF THE INVENTION

Hand-held candy and tablet dispensers constructed from a rigid material such as plastic for storing stacks of regularly shaped tablets to be output from their tops, one at a time, are very popular and widely used. These dispensers generally comprise a housing having a spring and follower that compresses the stack of tablets contained within the housing. A pivoting cap usually covers the open top area of the housing. The opening for dispensing tablets is generally placed on the side of the housing so that tablets must be slid sideways to be removed. When the cap is pivoted upwardly, it allows a topmost tablet to be removed. The caps often also include a pusher device that engages an end of a tablet to simultaneously force it out of the side opening in as the cap is pivoted. Dispensers having decorative or functional pivoting caps with pusher devices are disclosed in U.S. Pat. Nos. 2,620,061 2,853,206, 3,410,455, 3,942,683, 4,171,753, 4,295,579, and 4,311,251.

These dispensers allow for effective and relatively quick dispensing of tablets. However, their operation may sometimes prove awkward since the user must, while gripping the dispenser like a handle, place a thumb upon an upper surface of the cap and utilize suitable leverage to pivot it open. The user often finds it difficult, however, to maintain a firm grip on the dispenser while pivoting the cap.

Another disadvantage encountered in prior art designs is the unitary structure of the dispenser housing. In the event of a dislocation of the spring follower, or a breakage of tablets causing a jam, the interior of the permanently assembled housing may be difficult to access and repair. If so, the dispenser may be permanently rendered inoperable. Furthermore, the user may load and unload tablets only through the top, one at a time in older designs since the top opening is the only access to the interior of the housing.

SUMMARY OF INVENTION

It is therefore an object of the present invention to provide a hand-held gum and tablet dispenser having an improved dispensing mechanism that allows easier dispensing of tablets with a single gripping hand.

It is yet another object of this invention to provide a gum and tablet dispenser that is easy to disassemble for quicker loading and effective repair.

A hand held gum and tablet dispenser according to this invention provides a housing having first and second vertically oriented chambers defined by bottom and side walls and a panel separating the chambers. Each of the chambers has openings at the top. There is a magazine open at the top and removably mounted in the first chamber for holding a stack of gum or candy tablets. There are means in the magazine for yieldably urging the stack of tablets upwardly to the top of the magazine. A discharge opening is located adjacent the top of the magazine for allowing the tablets to be expelled from the magazine. At the top of the magazine there is a hold down bar for preventing the tablets from being forced out the top.

A cover is pivotally mounted on the magazine for closing and opening the top of the housing and the discharge opening. The cover carries a pusher which forces the topmost tablet in the stack out of the discharge opening when the cover is pivoted to open the discharge opening. There is a slide mounted in the second chamber for upward and downward movement therein. A bar also mounted in the second chamber connects the cover and the slide for pivoting the cover between the open and closed position as the slide moves downwardly and upwardly in the second chamber. The slide has a thumb grip accessible from the outside of the housing that allows the user to manually move the slide.

In one embodiment, a wall of the magazine forms the panel separating the chambers. The housing, additionally, includes detents upon inner faces of its side walls for lockably engaging protruding snap ears on the magazine outer side walls. The housing may include two joined halves and the thumb grip may include a textured face for improving contact of a gripping finger. The means for yieldably urging the stack of tablets upwardly in the magazine may include a compression spring, a base having a guide for retaining a spring and a follower platform opposite the base for compressibly contacting the stack. The platform may have extended guiding shoulders formed upon its sides for engaging vertically oriented slots in the magazine and corresponding indentations on inner faces of the housing side walls. The vertically oriented slots and the corresponding indentations on the housing side walls may define upper and lower edges to limit vertical movement of the platform.

The dispenser may further comprise spring means that bias the slide in order to maintain the cover in a closed position until the spring means is overcome by finger pressure. The cover may then be opened, but will close when finger pressure is released due to the action of the spring. The dispenser cover may resemble a variety of different shapes such as a cartoon character head.

In particular, a pivoting cover for a tablet dispenser according to this invention may include a structure that covers the discharge port of a tablet dispenser in a closed position. The structure may carry holes connecting it to pivot pins in the top end of the dispenser. The structure may, thus, pivot away from a closed position. The structure may also carry a pusher means that forces the topmost tablet out of the discharge port as the cover pivots away from the closed position. Slide means may be positioned on the side wall of the dispenser and may be connected to the cover to cause it to pivot.

BRIEF DESCRIPTION OF THE DRAWINGS

The above and other objects, advantages and features of the present invention will be more fully understood with reference to the following detailed description of two embodiments, taken in conjunction with the accompanying drawings in which.

DETAILED DESCRIPTION OF THE PREFERRED EMBODIMENTS

Figure 1:
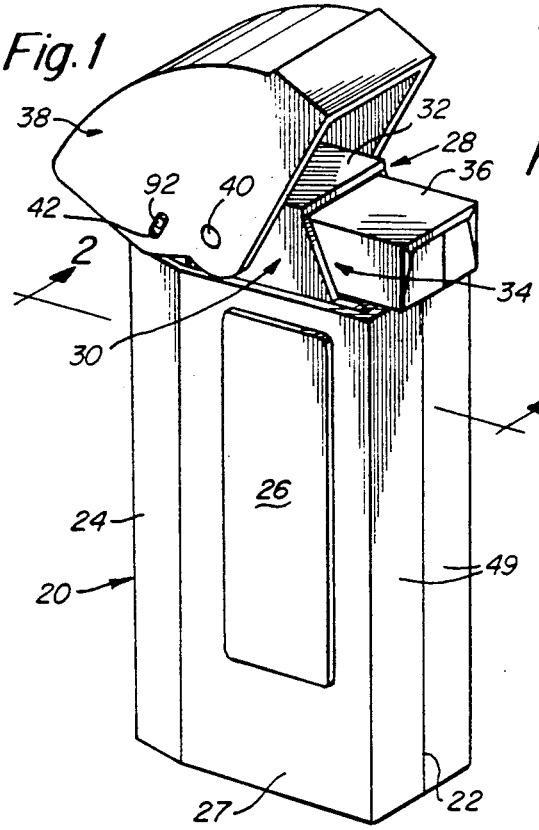
FIG. 1 is a perspective view of the exterior appearance of a hand held dispenser according to this invention with the cover open to dispense a protruding piece of gum.
Figure 2:
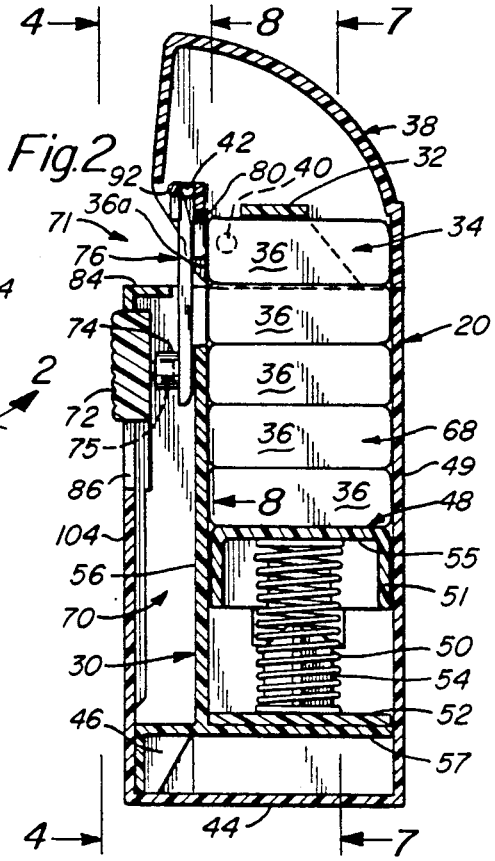
FIG. 2 is a cross sectional side view of the dispenser of FIG. 1 with the cover closed.

FIG. 1 shows the exterior view of a hand-held tablet dispenser. Although the dispenser in this example dispenses wrapped pieces of gum 36, this should not be construed to limit the applicability of this invention, since dispensing of any form of candy or tablet is contemplated.

The main body of the dispenser includes a housing 20 formed in two halves that are joined along an elongated vertical direction at a seam 22. A pair of inwardly tapered edges 24 also run in the elongated direction near the rear of the dispenser to improve the user's ability to grip the dispenser like a handle. An outwardly protruding elongated surface 26 stands out from the housing side wall 27. This surface includes a corresponding channel (not shown in FIG. 1) on the inside face of the side wall 27 to be described further below. Also visible at the top end of the housing 20 is a protruding top portion 28 of an internal magazine 30. This magazine 30 includes a top hold down bar 32 that forms the magazine's upper surface and also defines a side-facing discharge port 34 from which the wrapped piece of gum 36 protrudes.

A cover 38 pivots on the top of the magazine 30 by pivot pins 40 that may be molded in the sides of the magazine and that respectively engage each of a pair of holes 41 (see FIG. 10) in the cover. The figure depicts the magazine cover 38 in an open position in which the discharge port 34 is revealed. A pair of slots 42 in the cover 38 containing corresponding second pivot pins 92 interconnects with the cover opening mechanism.

In a closed position, the cover 38 completely encloses the discharge port 34 and top of the magazine. The cover has a shape that fits flushly with the housing's outer wall.

FIGS. 2-14 detail the interior elements of the dispenser. The floor of the magazine 30 is supported above the housing base 44 by means of an integrally molded pedestal 46. The magazine 30 contains a stack of gum pieces 36 or other regularly shaped items forced against its top hold down bar 32 by means of a spring-loaded platform 48. The platform side walls 51 closely abut inner faces of the magazine's rear wall 56 and side walls 53, and also abut the inner face of the housing's front wall 49 to prevent the platform from moving side-to-side. The platform 48 maintains compressive pressure on the base of the stack using a spring 50. The spring presses against the lower side 55 of the platform 48, remaining firmly seated on the lower side 55 of the platform by means of the surrounding platform side walls 51. The spring also maintains alignment relative to the magazine by means of a base piece 52 that sits snugly on the bottom floor 57 of the magazine and that also includes an integral spike 54 sized to firmly engage the inner diameter of the spring 50. The spring rides upon this guiding spike 54 as it compresses and expands.

Figure 10:
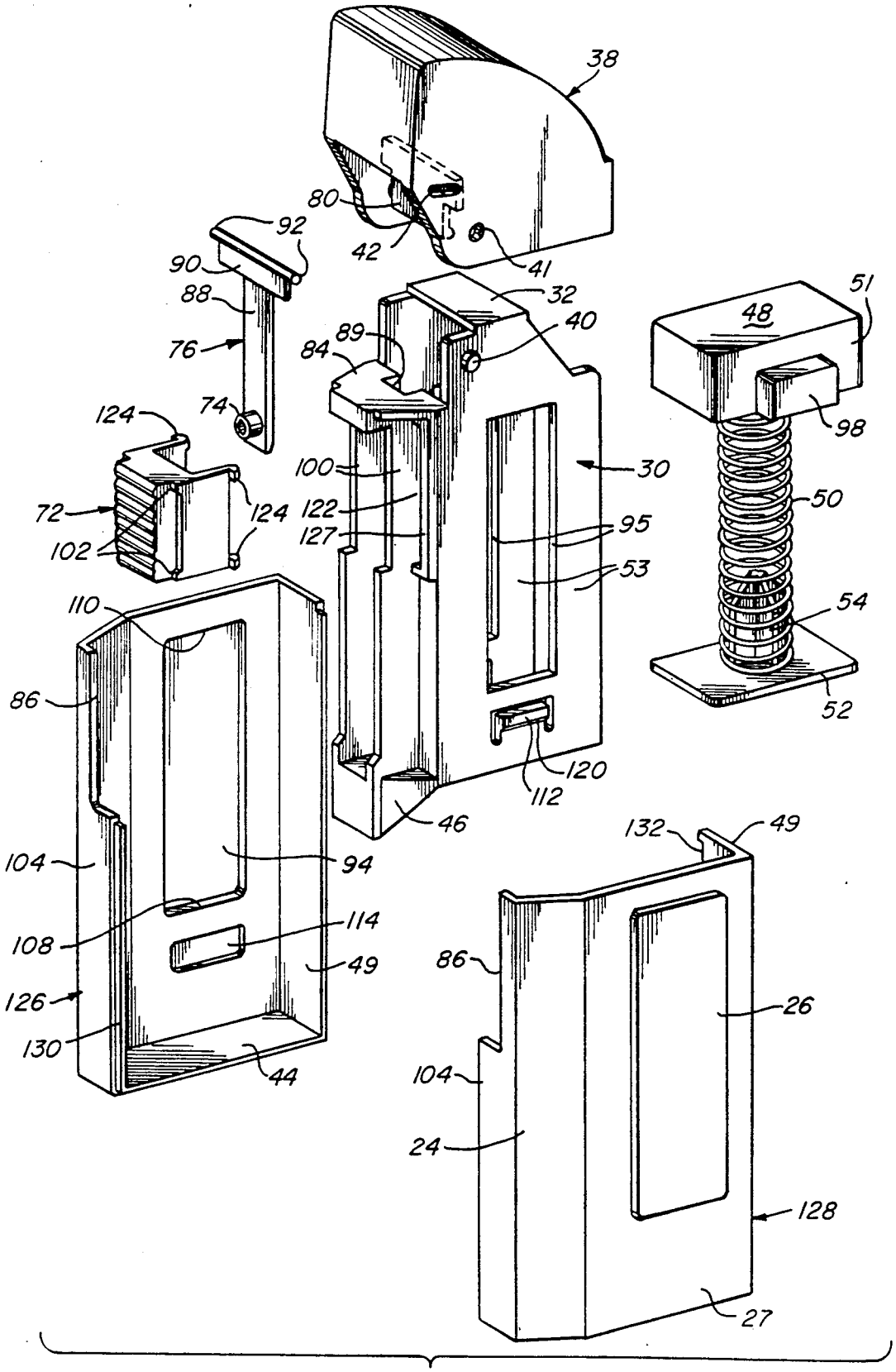
FIG. 10 is an exploded perspective view of the various parts of the dispenser of FIG. 1.

The rear wall 56 of the magazine 30 serves to form two chambers within the housing 20. The first chamber 68 contains the tablet stack. The second chamber 70, which is bounded on its sides by the tapered edges 24 of the housing, shown in FIG. 1, and on its front and rear by walls 56 and 104 respectively, contains the cover opening mechanism 71. The opening mechanism comprises a thumb slide 72 connected by an integral pin 75 to a boss 74 molded on a transfer bar 76 that rises through the second chamber 70 and interconnects with the cover pivot slot 42. FIG. 10 details the individual pieces of the mechanism 71.

A slot 86 cut into the rear wall 104 of the housing specifically enables the thumb slide to travel in a vertical direction. The slot is detailed in FIG. 4. As the slide moves downwardly (see arrow 78 in FIG. 3), it carries the transfer bar 76 with it. This, in turn, causes the cover 38 to pivot on the pins 40 to the open position (arrow 79). Note that the magazine 30 includes an integrally molded top wall 84 (see also FIG. 10) that fits flushly against the inner faces of the housing rear wall 104 and tapered edges 24. The top wall 84 serves not only to enclose the top of second chamber 70, but to block the lower edge of the transverse T-shaped top 90 of the transfer bar 76 to limit the transfer bar's downward movement, thus, preventing overextension of the slide 72 or cover 38.

Figure 4:
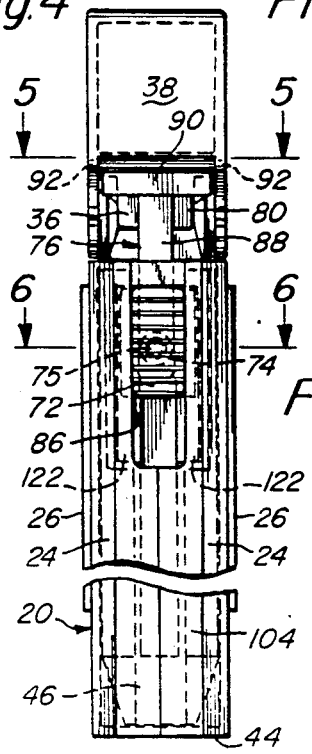
FIG. 4 is a rear elevation view of the dispenser of FIG. 2 taken along line 4—4.

The transfer bar 76 generally comprises an elongated section 88 that integrally includes the boss 74 that joins with the thumb slide's pin 75 (shown in phantom in FIG. 4). The elongated section rises through a notch 89 (FIG. 10) in the top wall 84 and carries a transverse top 90 that projects from the housing 20. The top 90 has pivot pins 92 disposed upon its opposing ends that engage the slots 42 in the cover 38.

Figure 3:
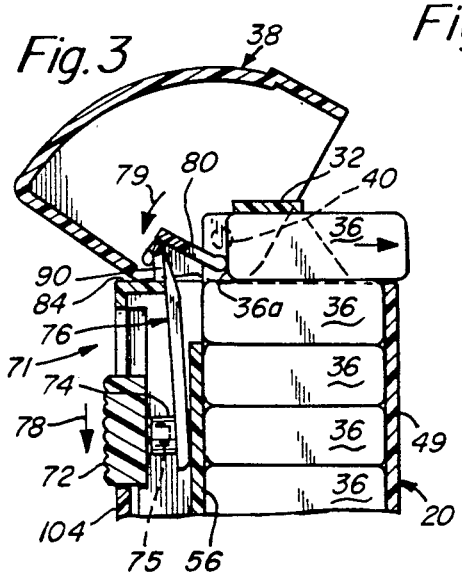
FIG. 3 is a fragmentary cross-sectional side view of the dispenser of FIG. 2 showing the cover pivoted to an open position to discharge a piece of gum.

The pusher 80 on the cover 38, as shown in FIGS. 2-4 and 10, which discharges the tablets, may be molded integrally with the cover. It extends downwardly to contact the approximate center portion of the end wall 36*a* of the tablet which in this case is a gum piece 36. Because the width of the pusher is less than the space between the magazine side walls 53, it passes freely between them as the cover 38 pivots. As the cover 38 rotates to the open position, the pusher 80 also rotates, urging the uppermost gum piece out of the discharge opening 34 as illustrated in FIG. 3. The thumb slide 72 includes a serrated surface. Such a surface texturing allows for improved grip during operation.

Figure 5:
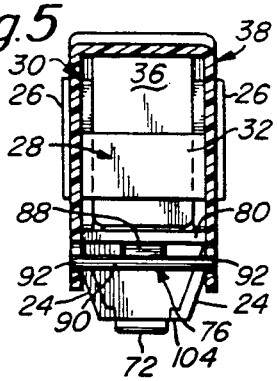
FIGS. 5 and 6 are cross sectional views of the dispenser of FIGS. 1-4 taken along lines 5—5 and 6—6 of FIG. 4 respectively.

FIG. 5 particularly details the top end of the dispenser 28 with the top of the cover exposed. The top hold down bar 32 is clearly visible as well as the pusher 80 and the transfer bar top 90. Note that the transfer bar pivot pins 92 extend through the side walls of the cover 38. Because the cover is constructed of a pliable material, this interconnection may be accomplished by snap fitting the pivot pins 92 into the cover slots 42. The cover as a whole may also snap fit onto the magazine pivot pins 40 to secure it to the top of the magazine 30.

Figure 6:
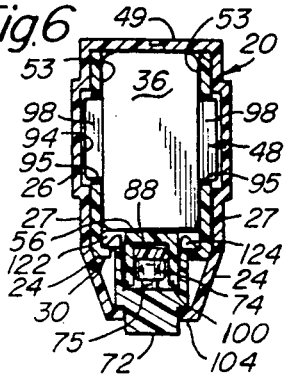
Figure 9:
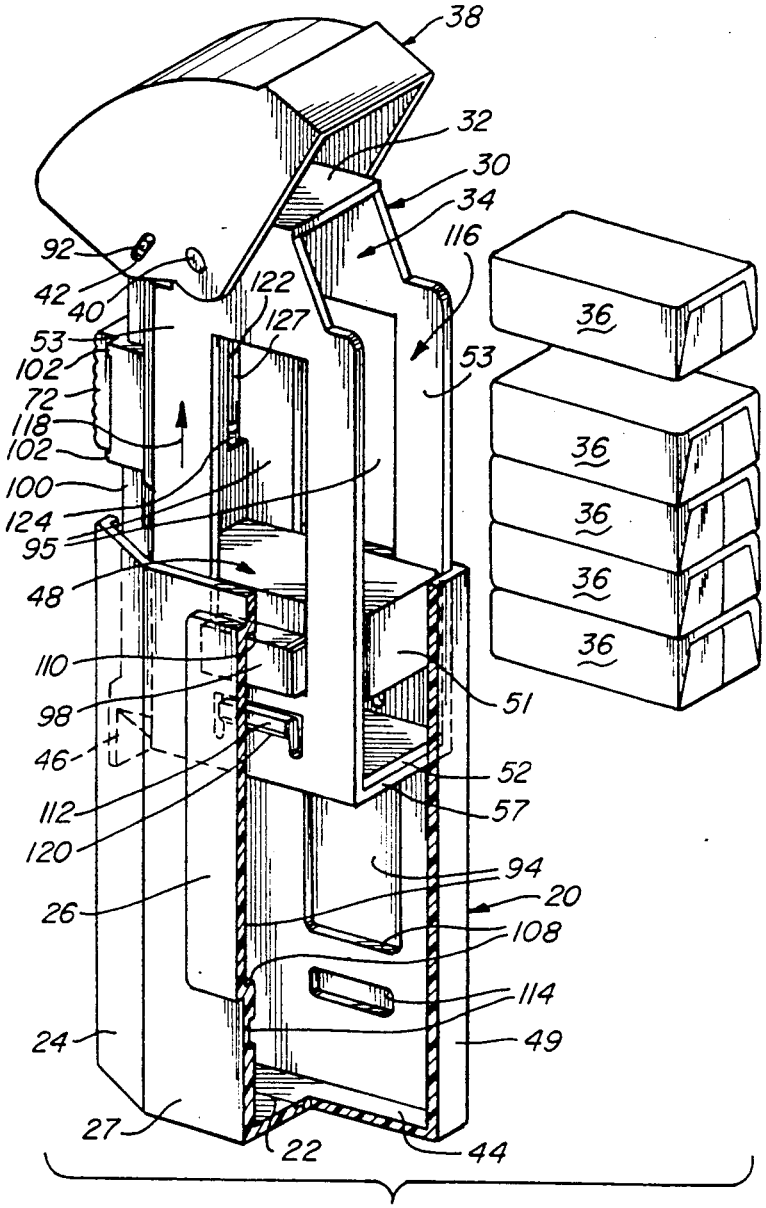
FIG. 9 is a partially exploded cutaway perspective view of the dispenser of FIG. 1.

As noted above, the housing 20 includes a pair of protruding surfaces 26 along its outer faces of the side walls 27 (see FIGS. 6, 9 and 10). These protruding surfaces allow the formation of corresponding channels 94 along the inner faces of the side walls 27 of the housing 20. These channels 94 correspond with through slots 95 in the magazine side walls 53 in which ride follower platform shoulders 98 that extend outward in opposite directions from the platform 48. These shoulders 98 assist the platform 48 in maintaining alignment as it moves vertically upward and downward in the housing during the loading and unloading process.

As shown in FIGS. 1, 9 and 10, the protruding surfaces 26 and corresponding inner channels 94 extend vertically for a distance that is less than the total length of the dispenser housing 20. Therefore, the platform shoulders 98 may travel for only a limited distance vertically within the channels 94. This prevents the follower platform 48 from rising too high and blocking the discharge port when all the gum pieces are unloaded and, similarly, prevents overloading of the magazine which may damage the spring 50 and base piece 52 due to overcompression. The platform movement is particularly limited to boundaries defined by the channel's lowermost and uppermost edges 108 and 110, respectively, as shown in FIGS. 7 and 10.

FIGS. 6 and 10 also depict a pair of rails 100 over which the thumb slide 72 travels. The slide is prevented from moving side-to side by these rails. Similarly, its displacement inwardly into the housing is prevented by the rear magazine wall 56, while its outward displacement is prevented by the engagement of a set of shoulders 102 on the thumb slide 72 with the inner face of the rear housing wall 104. Thus, it is firmly fixed to the dispenser, and only moves upwardly and downwardly in the second channel 70. The transfer bar 76 and its boss 74 that engages the pin 75 on the thumb slide 72 move in the space between the rails 100.

Figure 7:
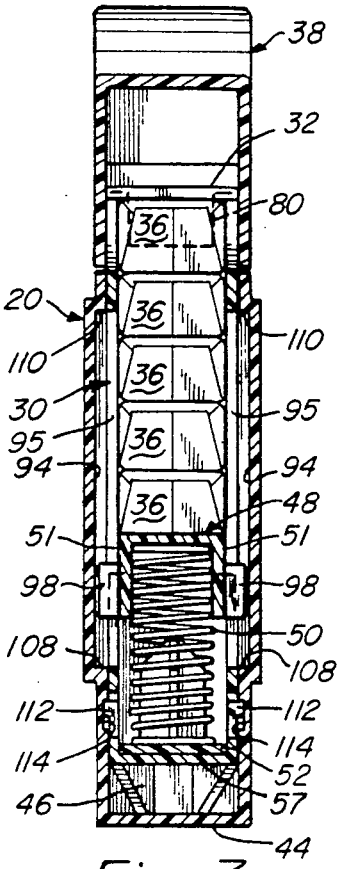
FIG. 7 is a cross-sectional front view of the dispenser taken along line 7—7 of FIG. 2.
Figure 8:
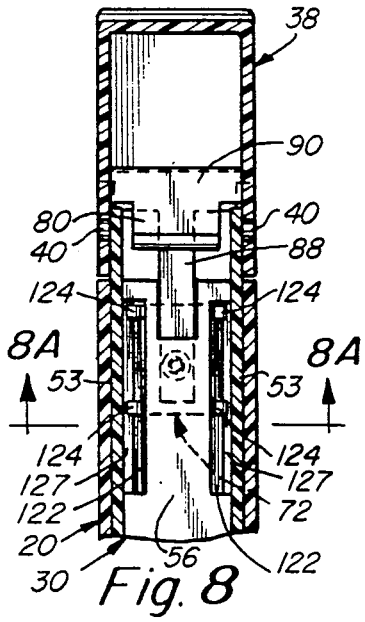
FIG. 8 is a fragmentary cross sectional rear view of the dispenser taken along line 8—8 of FIG. 2, detailing the slide mechanism.

Another feature depicted in FIGS. 7, 9 and 10 is the pair of protruding snaps 112 molded into the side walls 53 of the magazine 30 that lockingly engage corresponding indentations 114 in the inner faces of the side walls of the housing 20 near the bottom of the dispenser.

Because the dispenser housing and magazine are constructed of a pliable material such as molded plastic, the locking force exerted by the indentations 114 may be overcome with moderate pulling force, allowing the magazine to be slid upward out of the open top of the housing. The cutaway exploded view of FIG. 9 details the appearance of the magazine 30 as it is pulled out of the housing 20. As the magazine is pulled upward as shown by arrow 118, the follower platform shoulders 98 encounter the uppermost edges 110 of the channel 94, so that in the process of pulling, the platform 48 is depressed to its lowermost position in the magazine. Note that the magazine cannot be easily pulled totally out of the housing because the follower shoulders 98 catch upon the uppermost edges 110 of the channel 94. For that reason, the housing is molded in halves that are permanently assembled after the magazine and its follower platform assembly are positioned between them.

The engagement of the shoulders 98 with the uppermost channel edges 110 when the magazine 30 is fully pulled upward (FIG. 9) exposes most of the open front 116 of the magazine 30 and allows tablets to be or removed along the entire length of the open front. Since the cover 38 and the thumb slide mechanism 71 are completely and independently connected to the magazine 30, nothing in the magazine top area 28 interferes with its upward removal. The slot 86 for the thumb slide 72 on the housing 20 is open at the top allowing the thumb slide to be pulled freely upwardly out of the housing. When the magazine is reloaded, it may be slid again downwardly into the housing where it is secured at the bottom by its snaps 112 engaging with the indentations 114.

The magazine's 30 downward movement is limited by the bottom oriented supporting pedestal 46. In a fully inserted position, the magazine should both rest with the pedestal abutting the housing base 44 and with the snaps 112 firmly in the indentations 114. These indentations may include slightly tapered edges 120 to reduce resistance between the snaps 112 and indentations 114 and, hence, facilitate removal of the magazine from the housing.

Figure 8A:
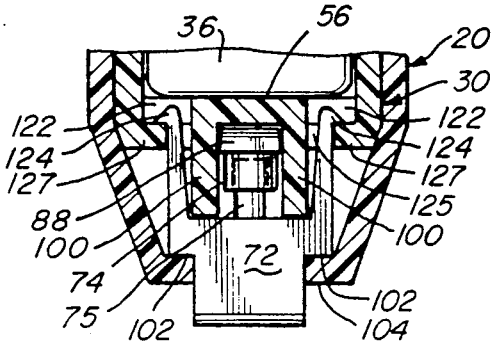
FIG. 8A is a fragmentary cross sectional view taken along line 8A—8A of FIG. 8.

As noted above, the entire opening mechanism 71 is independent of the housing, which also facilitates easy removal of the magazine from the housing. A pair of locking rails 127 (detailed in FIGS. 8, 8A, 9 and 10) cooperate with a set of four thumb slide retaining fingers 124 that are hooked thereon. Two fingers 124 are molded upon each side of the thumb slide and ride upon the rails 127. Channels 122 cut behind each rail 127 provide clearance for the fingers 124 as they travel along the rails. The retaining fingers 124 keep the opening mechanism 71 positioned on the magazine when it is removed from the housing. The fingers 124 are necessary upon removal since the outer-facing shoulders 102 of the thumb slide 72 no longer contact the inner surface of the rear housing wall 104. The fingers 124 are shaped in the form of hooks that overlap the rails 127 but, since a pliable material is utilized to construct the thumb slide 72, they snap into place upon the rails 127 using moderate pressure. A clearance 125 (FIG. 8A) is also provided between the thumb slide rails 100 and locking rails 127 to allow displacement of the snaps during fitting.

As revealed in FIG. 10, each part of the dispenser may be molded separately, preferably from a pliable and durable plastic material such as polystyrene. The only two parts that require adhesion are the two halves of the housing 20. The left half 126 includes a protruding half lap joint 130 that is shaped to mate with an indented corresponding half lap joint 132 located upon the right housing half 128. The two halves, once joined, may be permanently bonded by chemical or ultrasonic welding or by other appropriate methods. Of course, other construction methods and configurations of parts are possible and contemplated by this design.

Figure 11:
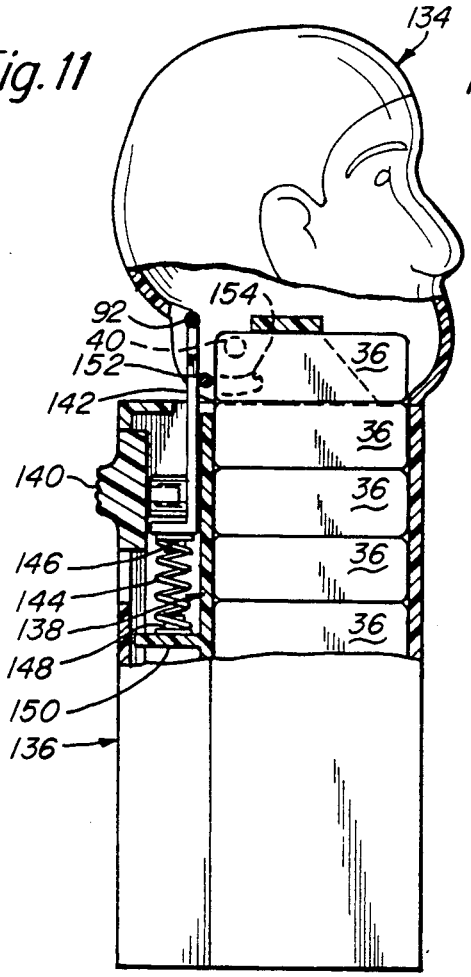
FIG. 11 is a partially broken away side view of an alternative embodiment for a hand held dispenser according to this invention.
Figure 12:
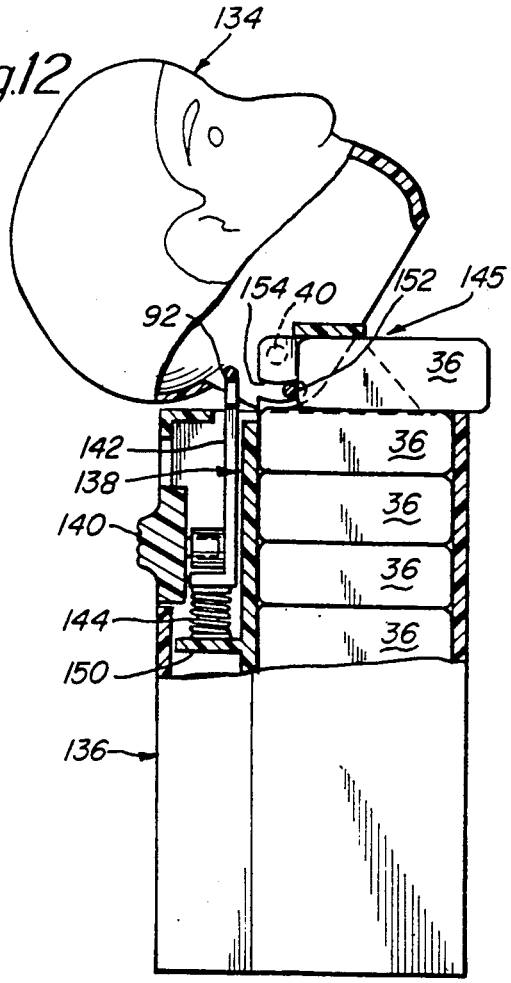
FIG. 12 is a partially broken away side view similar to FIG. 11 with the dispenser in an open position discharging a piece of gum.
Figure 13:
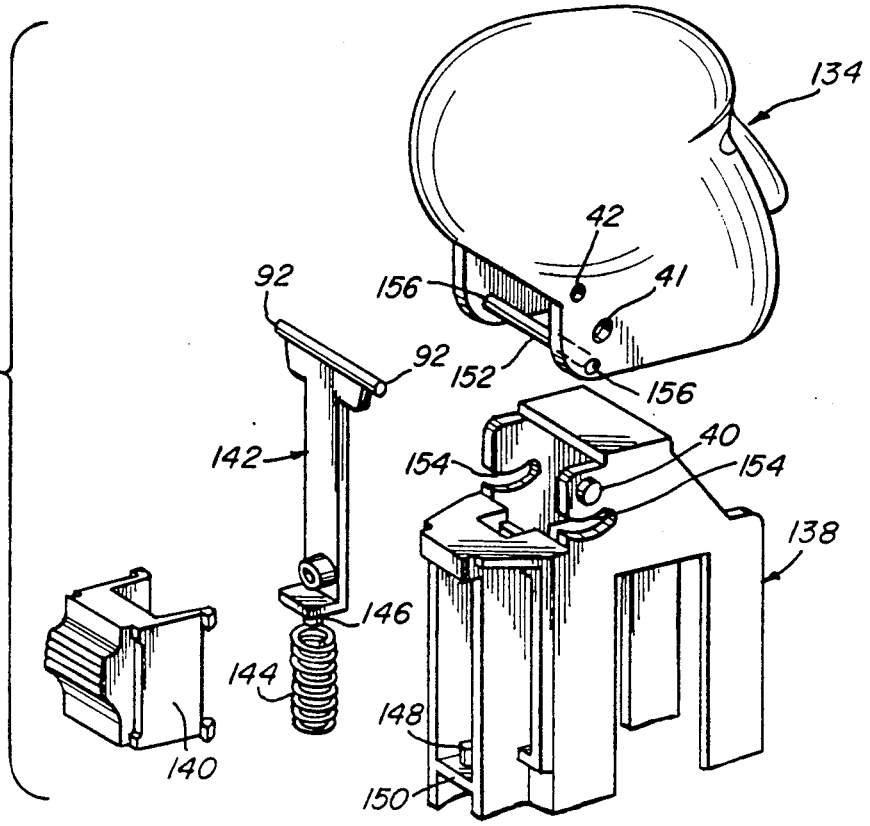
FIG. 13 is an exploded perspective view of the magazine, cover and opening mechanism of the embodiment of FIG. 11.

An alternative embodiment for a hand-held tablet dispenser according to this invention is shown in FIGS. 11–13. This embodiment also depicts dispensing of gum pieces, but intended to represent a general concept of a tablet dispenser. It includes a stylized decorative cover 134 which in this example is shaped as a caricatured head. The housing 136 is constructed in the same manner as the housing 20 of FIG. 1. However, the magazine 138 and the cover 134 include additional features not found in the embodiment of FIG. 1. The thumb slide 140 and transfer bar 142 are augmented by a compression spring 144 having one end seated into a pin 146 on the base of the transfer bar. The other end of the spring is similarly seated on a coaxial pin 148 rising out of a secondary base 150 constructed integrally with the magazine below the transfer bar 142. In a closed position, the spring remains partially compressed. This spring 144 ensures that the cover remains in a closed position and may only be pivoted open when the pressure exerted by the spring is overcome by firmly pushing downwardly upon the thumb slide 140. When the user, conversely, releases any pressure on the thumb slide, the slide is biased upwardly causing the cover to pivot closed.

The through mounted pusher bar 152 is an additional feature of this embodiment that allows for a wider variety of molded cover shapes. Unlike the integrally molded plate like pusher 80 used in the embodiment of FIG. 1, the pusher bar 152 only requires two coaxial holes 156 (FIG. 13) in the cover to carry the bar. Thus, the cover may be molded without being specifically adapted to an integral pusher as in FIG. 1, which allows for a wider variety of cover shapes. Since the bar spans the full width of the cover, special curved slots 154 must be molded into the magazine side walls to provide clearance for the bar as the cover pivots to an open position.

The action of the pusher bar 152 in an open pivoted position, as well as the compression of the spring 144, is detained in FIG. 12. A gum piece 36 in this figure protrudes from the opening 145.

The various elements of this spring loaded thumb slide embodiment are detailed in FIG. 13. Its final assembly is largely similar to that of the FIG. 1 embodiment.

It should be understood that the preceding is merely a detailed description of the preferred embodiments. It should be apparent to those skilled in the art that various modifications and equivalents can be made without departing from the spirit or scope of the invention.

What is claimed is:

1. A hand held tablet dispenser comprising a housing having first and second vertically oriented chambers defined by bottom and side walls and a panel separating the chambers, each of the chambers having openings at the top, a magazine open at the top and removably mounted in the first chamber for holding a stack of tablets, means in the magazine for yieldably urging the stack of tablets upwardly to the top of the magazine, a discharge opening adjacent the top of the magazine for allowing tablets to be expelled from the magazine, a hold down bar at the top of the magazine for preventing the tablets from being forced out the top, a cover pivotally mounted on the magazine for closing and opening the top of the housing and the discharge opening, said cover carrying a pusher which forces the topmost tablet in the stack out the discharge opening when the cover is pivoted to open the discharge opening, a slide mounted in the second chamber for upward and downward movement therein, and a bar mounted in the second chamber and connected between the cover and slide for pivoting the cover between the open and closed position as the slide moves downwardly and upwardly in the second chamber, said slide having a thumb grip accessible from outside the housing allowing the user to manually move the slide.

2. The tablet dispenser as set forth in claim 1 wherein the panel separating the chambers is formed by a wall of the magazine.

3. The tablet dispenser as set forth in claim 2 wherein the housing includes detents upon inner faces of its side walls for lockably engaging protruding snap ears upon outer faces of the magazine outer side walls.

4. The tablet dispenser as set forth in claim 3 wherein the housing includes two joined halves.

5. The tablet dispenser as set forth in claim 1 wherein the thumb grip includes a textured face for improving contact of a gripping finger.

6. The tablet dispenser as set forth in claim 1 wherein the means for yieldably urging the tablets upwardly includes a compression spring, a base having a guide for retaining the spring and a follower platform opposite the base for compressively contacting the stack of tablets.

7. The tablet dispenser as set forth in claim 6 wherein the follower platform includes extended guiding shoulders upon its sides for engaging vertically oriented slots in the magazine and corresponding indentations on inner faces of the housing side walls.

8. The tablet dispenser as set forth in claim 7 wherein the vertically oriented slots and corresponding indentations include upper and lower edges to limit vertical movement of the follower platform.

9. The tablet dispenser as set forth in claim 1 further comprising a spring that biases the slide to maintain the cover in a closed position until the spring is overcome by finger pressure.

10. The tablet dispenser as set forth in claim 1 wherein the cover includes a shape generally in the form of a head.

11. A hand-held tablet dispenser comprising:

an elongated container for holding regularly shaped tablets in a stacked arrangement relative to said elongated direction, said container including a closed base end and an oppositely disposed top end;

discharge means positioned at said top end including a hold down bar across said top end to prevent said tablets-from exiting directly out of the top and a discharge opening along container side wall sized to allow a tablet to exit said container when it abuts said bar;

means for biasing said stacked arrangement toward said top end;

pivoting cover means positioned at said top end including pusher means, responsive to an upward pivoting of said cover, for forcing a tablet abutting said bar out of said discharge opening;

a thumb slide mounted upon said container for displacement in said elongated direction; and means for interconnecting said thumb slide to said cover, said cover pivoting in response to displacement of said slide.

12. The tablet dispenser set forth in claim 11 wherein said container includes an outer housing and a removable inner magazine that holds said tablets.

13. The tablet dispenser as set forth in claim 12 wherein said inner magazine divides said container into a first chamber including said tablets and a second chamber including rails for guiding said thumb slide and means for interconnecting.

14. The tablet dispenser as set forth in claim 13 wherein said outer housing includes an opening along its side wall sized to allow said thumb slide to displace a predetermined distance in said elongated direction.

15. The tablet dispenser as set forth in claim 14 further comprising spring means that biases said thumb slide to maintain said cover in a closed position until said thumb slide is overcome by finger pressure.

16. The tablet dispenser as set forth in claim 13 wherein said rails include means for slidably securing said thumb slide to said magazine to prevent said thumb slide from separating from said magazine when said magazine is removed from said housing.

17. A thumb slide activated pivoting cover for a tablet dispenser having a plurality of spring pressurized stacked tablets stored therein and a port for discharging tablets positioned at a top end side wall of said dispenser, said cover comprising:

a cover structure that covers a discharge port of a tablet dispenser in a closed position;

a pivot upon said cover structure connecting said cover to a top end of said dispenser that allows said cover structure to pivot away from said closed position covering said discharge port;

pusher means that forces a topmost tablet out of said discharge port as said cover pivots away from said closed position; and thumb slide means positioned along a side wall of said dispenser and interconnected with said cover, said thumb slide means causing said cap to pivot in response to a sliding of said thumb slide means along said side wall.

18. The pivoting cover as set forth in claim 17 wherein said thumb slide is spring loaded to maintain said cover normally in a closed position.

* * * * *